US006637696B2

(12) United States Patent
Splane, Jr. et al.

(10) Patent No.: US 6,637,696 B2
(45) Date of Patent: Oct. 28, 2003

(54) DOUBLE ROLL ROLLING DEVICE AND METHOD

(75) Inventors: Robson L. Splane, Jr., Granada Hills, CA (US); Arthur John Drusch, Escondido, CA (US)

(73) Assignee: Suncepts, Inc., Los Angeles, CA (US)

( * ) Notice: Subject to any disclaimer, the term of this patent is extended or adjusted under 35 U.S.C. 154(b) by 113 days.

(21) Appl. No.: 09/987,341

(22) Filed: Nov. 14, 2001

(65) Prior Publication Data

US 2003/0089813 A1 May 15, 2003

(51) Int. Cl.[7] ..... B65H 18/08
(52) U.S. Cl. ..... 242/530; 242/532.5; 242/532.6
(58) Field of Search ..... 242/530, 160.2, 242/532.6, 532.5

(56) References Cited

U.S. PATENT DOCUMENTS 5,102,216 A * 4/1992 Mitchell ..... 351/156

* cited by examiner

*Primary Examiner*—John Q. Nguyen
(74) *Attorney, Agent, or Firm*—Larson & Taylor, PLC

(57) ABSTRACT

A method and device are provided for producing a double roll fabric construction useful as a receptacle for, e.g., eyeglasses. The construction is comprised of adjacent rolled up portions disposed in side by side relation so as to be unrollable to form a receiving space therebetween. The rolling device includes a pair of spindles disposed in parallel relation and adapted to respectively receive opposite ends of a stretchable fabric so that rotation of the spindles causes rolling up of the fabric around the spindles. Respective pinion gears are mounted on the spindles and are disposed in engagement with, and ride along, a rack member. A drive unit produces movement of the pinion gears toward each other along the rack member so as to produce rotation of the second spindles and resultant wrapping of the fabric around the respective spindles to produce respective fabric rolls of the double roll fabric construction. After the construction is removed from the spindles, the ends are sewn to produce the receptacle.

17 Claims, 6 Drawing Sheets

DOUBLE ROLL ROLLING DEVICE AND METHOD

FIELD OF THE INVENTION

The present invention relates to rolling devices or machines for rolling fabric into rolled up configurations and, more particularly, to a double roll rolling device, and a corresponding method, for providing a stretchy or elasticized fabric configuration comprising adjacent double rolls which can be unrolled to, e.g., create a receiving space for articles.

BACKGROUND OF THE INVENTION

Although the present invention is not limited to such an application, one important application of the device and method of the present invention is in making eyeglasses cases such as disclosed in U.S. Pat. No. 5,102,216 to Mitchell, the subject matter of which is hereby incorporated by reference. The eyeglasses case described in this patent comprises a stretchy or elasticized fabric which is double rolled and then sewn to tubular straps at each end to form an eyeglasses retainer-case combination, with the tubular straps being attached to the stems of the eyeglasses to retain the eyeglasses in place around the neck of a user. The double roll configuration of the case permits the eyeglasses to be placed, in folded state, within the cavity or receiving space formed by unrolling the normally rolled up double roll portions. Other products also use this double roll configuration of elasticized fabric and the present invention is applicable to making such devices as well.

SUMMARY OF THE INVENTION

In accordance with one aspect of the invention, there is provided a rolling device for producing a double roll fabric construction comprising adjacent rolled up portions disposed in side by side relation so as to be unrollable to form a receiving space therebetween, the device comprising:

first and second spindles disposed in parallel relation and adapted to respectively receive opposite ends of a stretchable fabric so that rotation of the spindles causes rolling up of the fabric around the spindles;

a rack member;

first and second pinion gears mounted on the first and second spindles, respectively, and disposed in engagement with said rack member; and drive means for producing movement of the first and second pinion gears toward each other along the rack member so as to produce rotation of the first and second spindles and resultant wrapping of the fabric around the respective spindles to produce respective fabric rolls of the double roll fabric construction.

Preferably, the device further comprises retaining means for retaining the fabric against the spindles so as to permit wrapping of the fabric around the spindles. Advantageously, the retaining means comprises first and second spaced, resilient fingers, between which said fabric is initially stretched, for holding the opposite ends of the fabric against the first and second spindles, respectively. The resilient fingers are preferably spaced apart a distance relative to the width of the fabric such that excess portions of the fabric extend beyond the fingers at both of said opposite ends of the fabric. Advantageously, the fingers comprise oppositely extending finger members formed integrally with a common base member.

Preferably, the device further comprises securing means for securing fabric to the spindles. The securing means preferably comprises respective removable clip members. Advantageously, the clip members comprise substantially semicircular mandrels.

The device preferably comprises first and second sliding blocks on which said first and second spindles are mounted. Advantageously, the device further includes a support assembly for supporting the device on a support member and the sliding blocks include bearings which engage, and ride on, linear bearing surfaces of the support assembly.

The drive means preferably comprises spindle movement control means for producing equal movements of the first and second pinion gears along the rack member. Advantageously, the spindle movement control means comprises a bell crank, and first and second links of equal length coupling the bell crank to the spindles. The bell crank is preferably mounted on the support assembly.

In accordance with a further aspect of the invention, there is provided a method for producing a double roll receptacle of a stretchable fabric comprising adjacent rolls of the fabric, the rolls having parallel longitudinal axes and being capable of being unrolled to form a receiving space therebetween, the method comprising:

disposing opposite ends of the stretchable fabric on first and second parallel spindles, respectively, so as to enable rolling up of the fabric on the spindles;

rotating the spindles to cause the fabric to be rolled onto the spindles from the opposite ends of the fabric so as to form a rolled fabric comprising two parallel rolls in side by side relation;

removing the rolled fabric from the spindles with the two parallel rolls formed in the fabric; and affixing the rolled fabric together at opposed longitudinal ends to form a double roll receptacle.

Preferably, an excess portion of fabric is initially created at the opposite ends (sides) thereof and each said excess portion is wrapped around the respective spindle.

Advantageously, the fabric is initially stretched across first and second spaced fabric retaining means to create the excess fabric portions.

Preferably, the excess fabric portions are removably clipped by clip members to the spindles so as to retain the fabric in place on the spindles and the clip members are removed prior to affixing the rolled fabric together at said opposed ends.

Other features and advantages of the invention will be set forth in, or apparent from, the detailed description of preferred embodiments of the invention, which follows.

DESCRIPTION OF THE PREFERRED EMBODIMENTS

Figure 1:
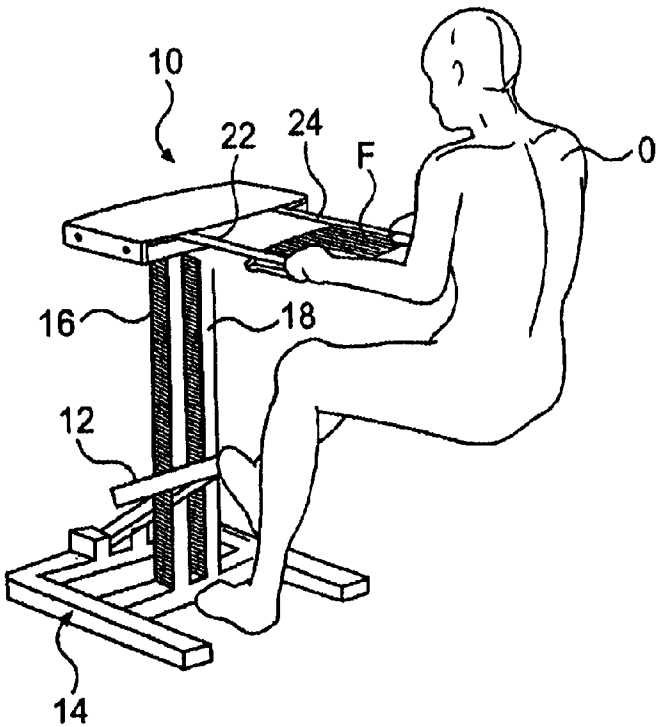
FIG. 1 is a simplified perspective view of a double roll apparatus in accordance with one preferred embodiment of the invention, showing an operator using the apparatus.

In order to provide an overview of a first embodiment of the invention, reference is first made to FIG. 1, wherein an operator O is shown seated in front of a double roll machine 10 constructed in accordance with one preferred embodiment of the invention. The operator O feeds a suitable length of elasticized fabric F into machine 10 and, in this embodiment, controls operation of the machine 10 by depressing and releasing of a pedal 12 pivotably mounted on a base portion 14 of the machine 10 and extending between a pair of support pillars 16 and 18. This movement of pedal 12 controls the movement of a drive belt 20 shown, inter alia, in FIG. 2, to, in turn, control movement of a pair of spindles 22 and 24.

Figure 2:
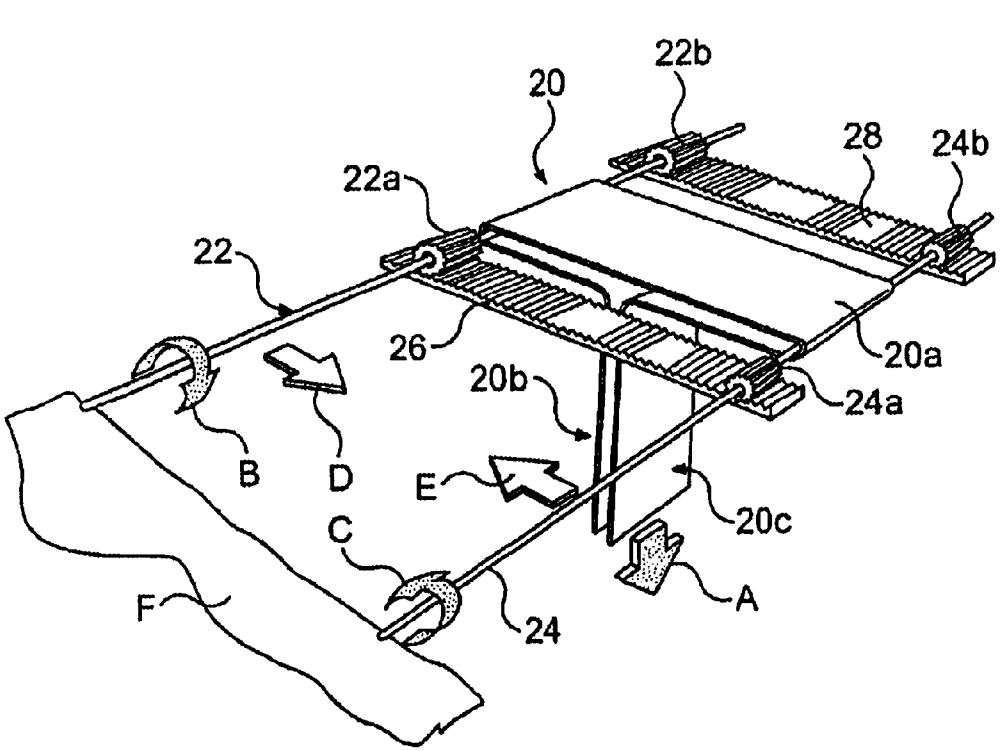
FIG. 2 is a simplified perspective view, drawn to a larger scale, of a portion of the apparatus of FIG. 1.

Referring to FIG. 2, as illustrated, belt 20 includes a horizontal portion 20*a* which is looped in a horizontal plane around the pair of spindles 22 and 24, and two vertically extending, downwardly depending portions 20*b* and 20*c* which are affixed to foot pedal 12 and, as indicated by arrow A, are pulled downwardly by pedal 12 when the latter is depressed.

Spindles 22 and 24 each include two spaced pinion gears 22*a*, 22*b* and 24*a*, 24*b*, respectively. Pinion gears 22*a* and 24*a* engage a first rack 26 disposed on one side of belt 20 while pinion gears 22*b* and 24*b* engage a second rack 28 disposed on the other side of belt 20.

It will be appreciated that pulling down on belt 20 in response to depression of pedal 12 will cause rotation of spindles 22 and 24 as indicated by arrows B and C, and consequent movement of spindles 22 and 24 toward each other as indicated by arrows D and E. This movement is effected by the travel of pinion gears 22*a*, 24*a* on rack 26 and of pinion gears 22*b*, 24*b* on rack 28.

Figure 3:
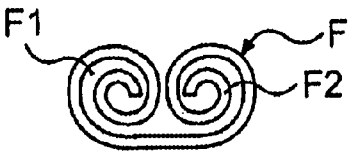
FIG. 3 is an end elevational view of a double roll fabric configuration produced by the invention.

The initially flat elasticized fabric F is engaged at opposite edges thereof by spindles 22 and 24 and thus rotation of spindles 22 and 24 causes the fabric F to roll up around the spindles 22 and 24 to produce two closely spaced rolled portions. When the fabric is removed or released from the spindles 22 and 24, the fabric will retain its rolled up configuration, i.e., the configuration shown in FIG. 3 in which two rolled up portions, denoted F1 and F2, are disposed adjacent to one another, as shown. As a final step, the ends of the double rolled fabric F are sewn, using, e.g., a bar tack machine (not shown), to produce the final doubled rolled receptacle or retainer device.

Figure 4:
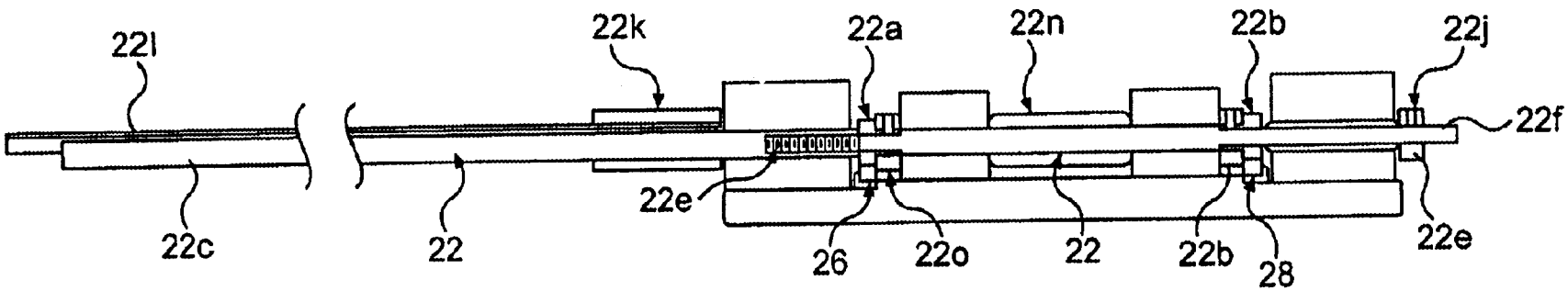
FIG. 4 is a side elevation view of the operating mechanism of the apparatus of FIGS. 1 and 2.
Figure 5:
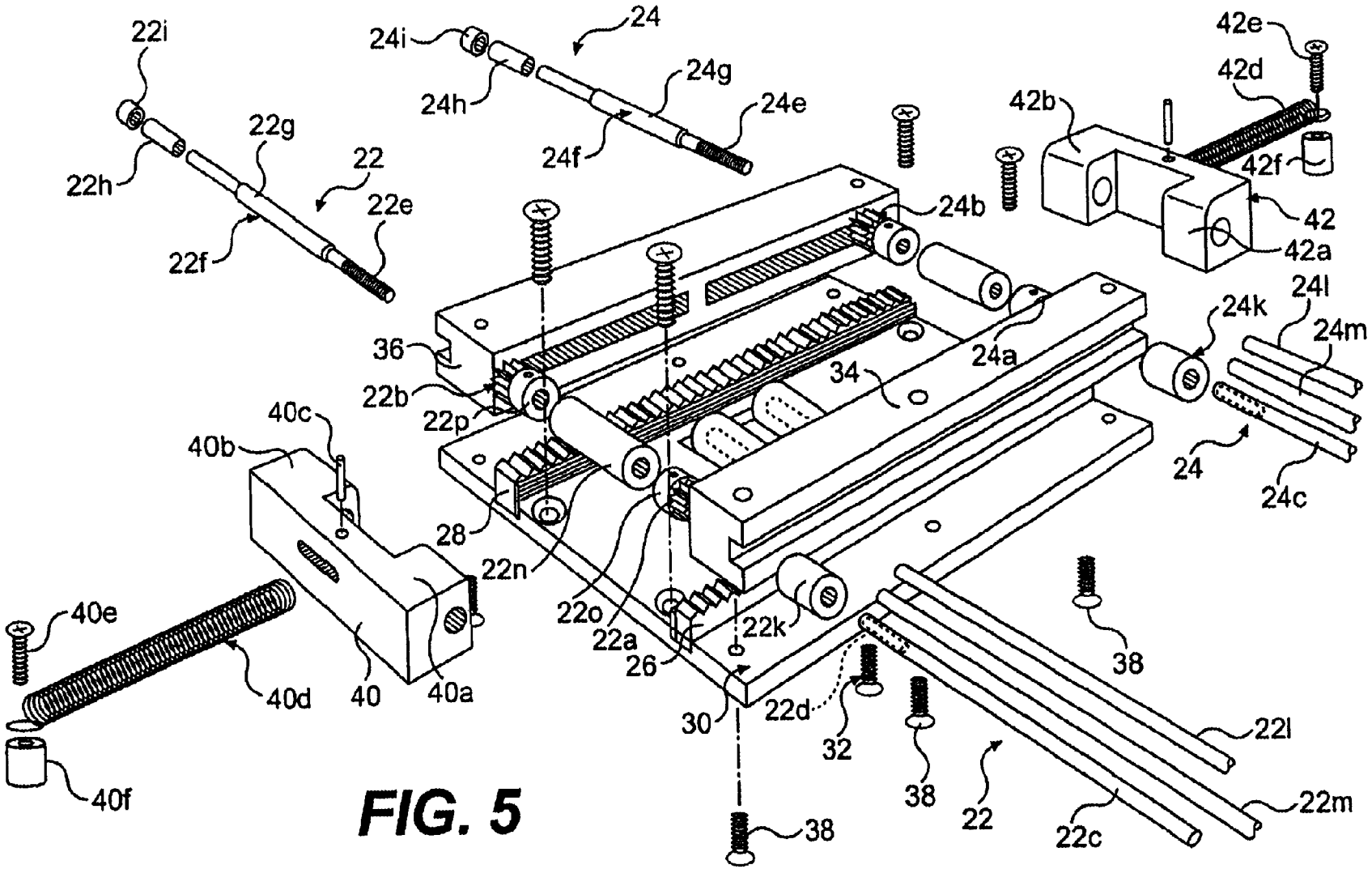
FIG. 5 is an exploded perspective view of the operating mechanism of FIG. 4.

Referring to FIGS. 4 to 8, there are shown further details of the preferred embodiment of the invention illustrated in FIG. 2. Referring first to FIGS. 4 and 5, in this specific embodiment, the spindles 22 and 24 are of a similar multipiece construction. Considering spindle 22 as typical and referring to FIG. 5, spindle 22 includes a spindle member 22*c* at the front end of the device 10 which has internal screw threading 22*d* adapted to receive the threaded end 22*e* of a further spindle member or armature 22*f*. The latter also includes a central portion 22*g* and a cooperating sleeve 22*h* and an associated collar or end cap 22*i* secured in place by a set screw 22*j* (see FIG. 4).

A short length of surgical tubing 22*k* surrounds the spindle member 22*c* and serves to mount upper and lower L-shaped channel members 22*l*, 22*m* used to grip the fabric to be rolled.

A cylindrical belt guide 22*n* is mounted on armature 22*f* while two further shaft collars, denoted 22*o* and 22*p*, respectively, serve in securing pinion gears 22*a* and 22*b* in place on spindle 22 as is best seen in FIG. 4.

As indicated above, spindle 24 is similar to spindle 22 and corresponding elements have been given the reference number 24 with the same letter designations, so that, e.g., spindle member 24*c* corresponds to spindle member 22*c*. Because of this similarity, spindle 24 will not be separately described.

Racks 26 and 28 are affixed to a base plate or mounting plate 30 by suitable means such as screws, one of which denoted 32, is shown in FIG. 5.

A pair of armature guide/retainer members 34 and 36 are affixed to base plate 30 by suitable means such as screws, three of which are shown at 38 in FIG. 5. The armatures 22*f*, 24*f* of spindles 22 and 24 extend through guide/retainers 34 and 36 as can be best seen in FIG. 5.

Also mounted or captured on spindles 22 and 24 are a pair of spring frames or frame members 40 and 42. The spring frames 40 and 42 and the associated spring mechanisms are of a similar construction and considering frame 40 as typical, frame member 40 is of a U-shaped configuration with the legs 40*a* and 40*b* thereof having aligned openings therein which provide mounting of frame member 40 on armature 22*f* of spindle 22. A set screw or other fastener 40*c* is used to affix one end of a spring 40*d* to frame member 40. The other end of spring 40*d* is affixed in place by a screw 40*e* and a screw retainer 40*f* affixed to a mounting platform 44 (see, e.g., FIG. 6) for base plate 30. Relatively long screws, indicated at 46, are used to secure base plate 30 to mounting platform 44.

Figure 7:
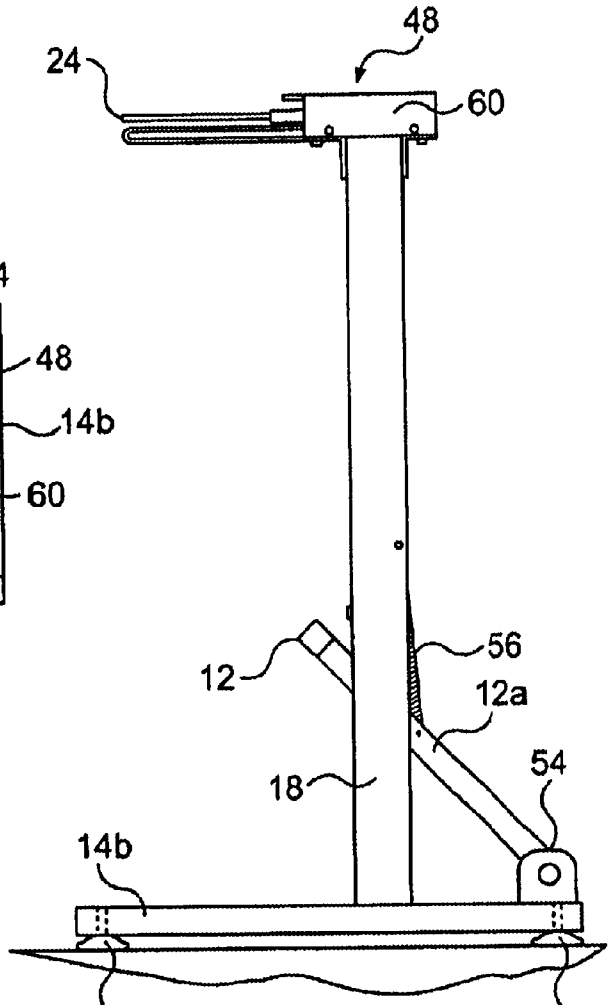
FIG. 7 is a side elevational view of the apparatus of FIGS. 1 and 2.
Figure 8:
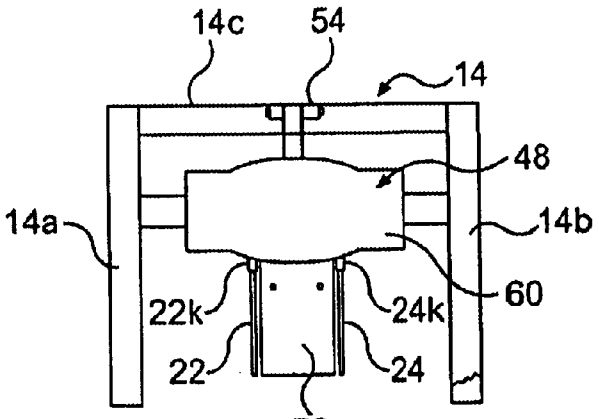
FIG. 8 is a top plan view of the apparatus of FIGS. 1 and 2.
Figure 6:
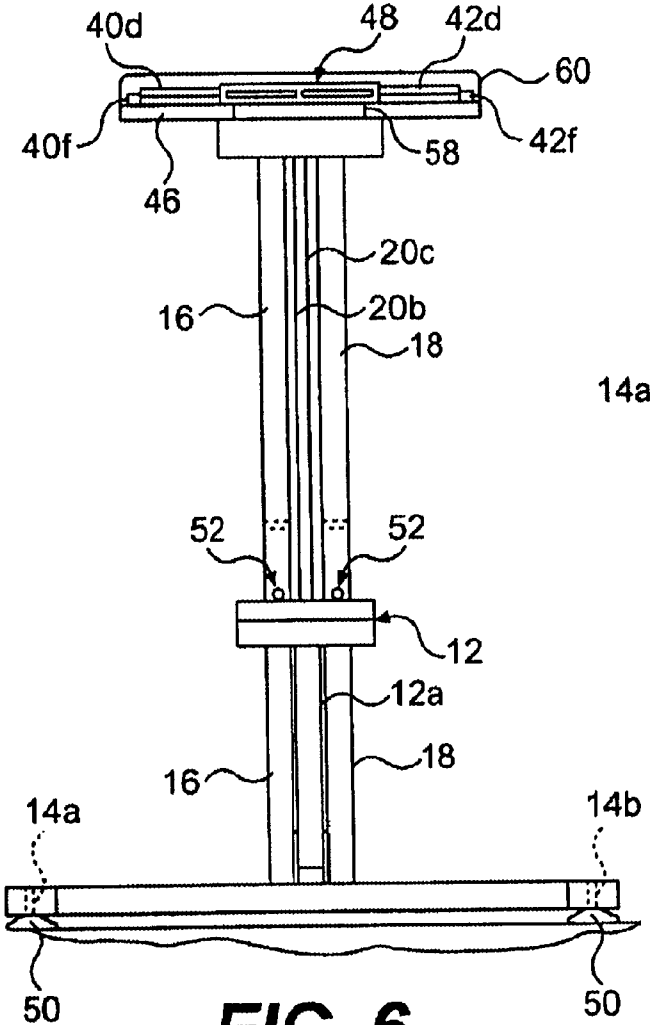
FIG. 6 is a front elevational view of the overall apparatus of FIGS. 1 and 2.
Figure 9A:
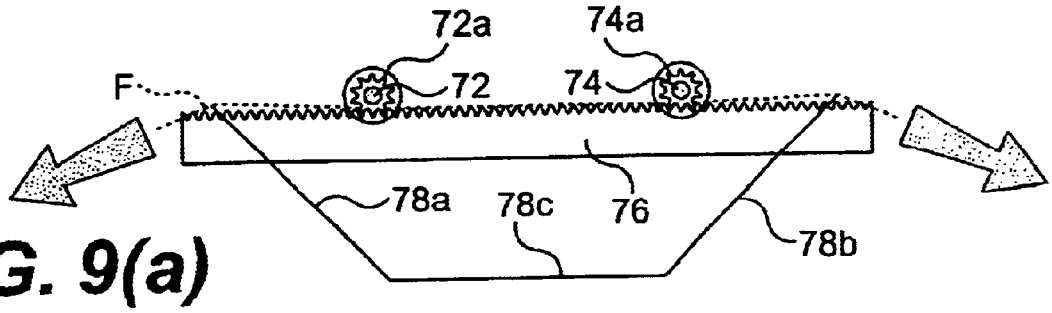
FIGS. 9(*a*) to 9(*e*) are simplified front elevational views of part of a double roll apparatus in accordance with a further embodiment of the invention.
Figure 9B:
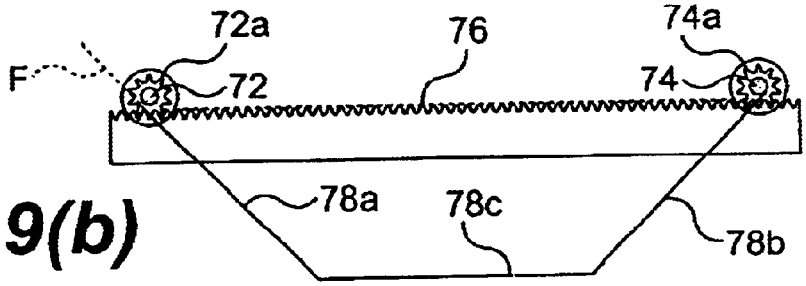
Figure 9C:
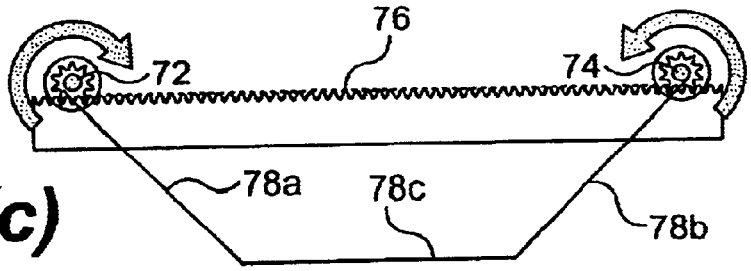
Figure 9D:
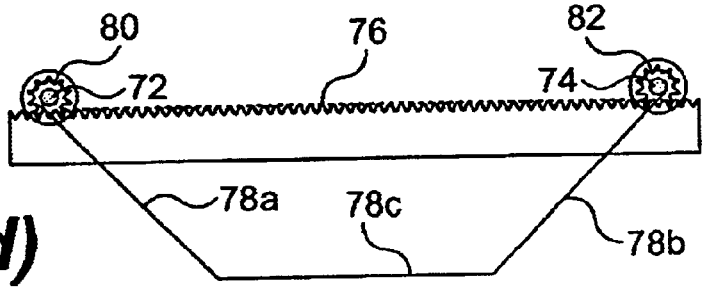
Figure 9E:
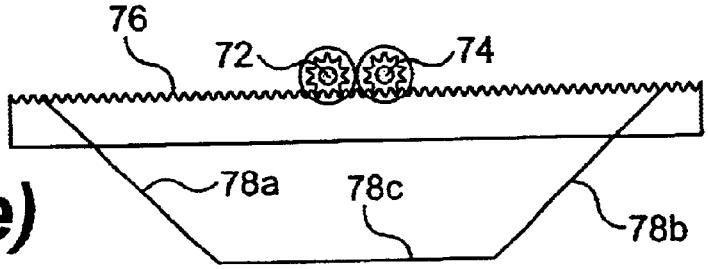

Referring to FIGS. 6 to 8, the pillar construction referred to above is shown in somewhat more detail, with the basic double roll mechanism shown in FIG. 5 being denoted 48. As illustrated above in connection with FIG. 1, pillars 16 and 18 are mounted to base 14 which includes parallel legs 14*a* and 14*b*. Leveling devices or levelers 50 affixed to legs 14*a*, 14*b* are used to support the device 10 in a level, stable manner. As described above, bolt portions 20*b* and 20*c* extend between pillars 16 and 18 and are affixed to pedal 12 while rubber bumpers 52 are disposed on pedal 12 as shown in FIG. 6.

As shown in FIGS. 6 and 8, a pedal link 12*c* of pedal 12 is pivotably mounted at one end by a simple pivot arrangement, indicated at 54, mounted on a cross strut 14*c* of base 14 and, as shown in FIG. 7, link 12*c* is also supported by a spring 56 affixed to support pillar 18. Two such springs are preferably provided.

To complete the description, an outwardly extending platform shield is indicated at 58 while a cover/housing for the drive mechanism 48 is denoted 60.

The basic operation of the embodiment of FIGS. 1 to 8 has been described above.

Referring to FIGS. 9(*a*) to 9(*e*), 10 and 11, a further, currently preferred embodiment of the invention is shown. This embodiment is broadly similar to that of FIGS. 1 to 8, while providing certain important advantages thereover, and to provide an overview reference is first made to FIGS. 9(*a*) to 9(*e*) which show five steps in the double roll operation provided by this embodiment.

As described in more detail below, the double roll unit of this embodiment, which is generally denoted 10, includes, similarly to the embodiment of FIGS. 1 to 8, and as shown in FIG. 9(*a*), a pair of spindles 72 and 74 which carry respective pinion gears 72*a* and 74*a* that engage a common rack 76. In contrast to the previous embodiment, the fabric, again denoted F, is held in place by two fingers 78*a* and 78*b* preferably made of sheet metal and connected to a common base indicated schematically at 78*c*. As shown in FIG. 9(*a*), the fabric or material F is spread across the fingers 78*a*, 78*b* and the spindles 72, 74 are located in an intermediate position.

As shown in FIG. 9(*b*), the spindles 72, 74 are next caused to move on rack 76 to the outermost positions thereof wherein the spindles 72, 74 hold end portions of the fabric F against fingers 78*a*, 78*b*, with some excess fabric being left at the edges. The operator, of course, releases the fabric at this point. In this embodiment, a knee pad actuator (not shown) is preferably used to effect this movement of spindles 72, 74. However, it will be appreciated that the pedal and belt arrangement of FIGS. 1–8 could also be used and that other suitable actuators for the spindle drive mechanism described below could also be employed.

Referring to FIG. 9(*c*), in the next step, the excess fabric at the ends is wrapped around the two spindles 72, 74. This prepares the fabric F for fastening or securing of the ends thereof.

With the excess material wrapped around spindles 72, 74, a pair of semicircular mandrels or clip members 80 and 82 are clipped onto the spindles 72. 74 so as to hold the fabric F in place, as illustrated in FIG. 9(*d*).

Next, as shown in FIG. 9(*e*), the actuator (knee pad) mechanism is pressed in the opposite direction so as to draw the spindles 72, 74 together. The spindles 72, 74 travel equal distances along rack 76 and the fabric F is drawn up onto the spindles 72, 74 equally. Thereafter, the rolled up fabric is removed and is sewn as described above to produce the final double rolled product.

Figure 10:
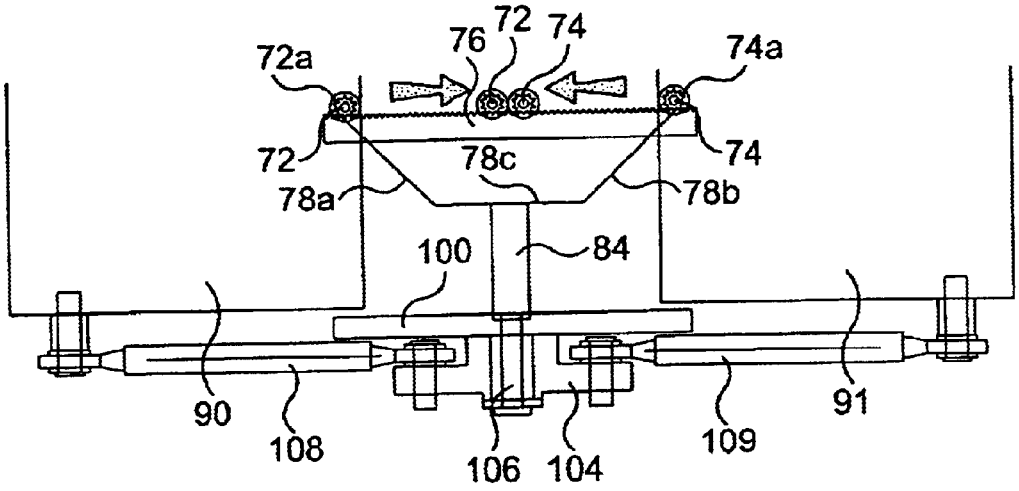
FIG. 10 is a front elevational view of the apparatus of FIGS. 9(*a*) to 9(*e*)
Figure 11:
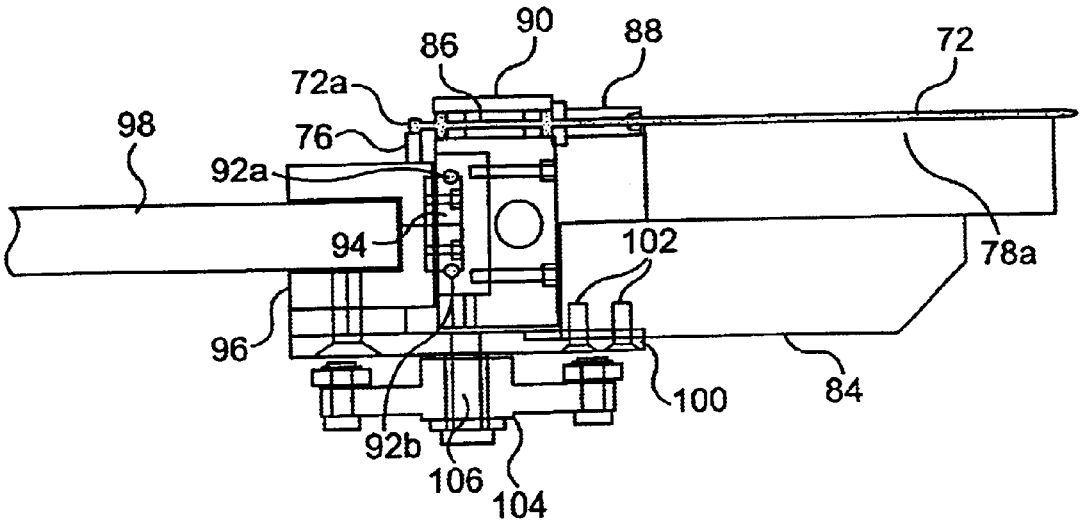
FIG. 11 is a side elevational view of the apparatus of FIG. 10.

Referring to FIGS. 10 and 11, the drive or actuator mechanism for spindles 72, 74 is shown. As illustrated, the spring fingers 78*a*, 78*b* are mounted on a central support arm 84 which is affixed to base 78*c*.

As shown in FIG. 11 for pinion gear 72*a* of the two pinion gears 72*a*, 74*a*, pinion gear 72*a* is mounted on a ball bearing shaft 86 which is coupled by a coupling element 88 to spindle 72 and which is mounted in a sliding bearing block 90. The bearing block 90 is preferably made of aluminum or the like and, in the illustrated embodiment, is of the multipiece construction shown. A u-shaped bearing portion 90*a* of bearing block 90 slides on a pair of linear bearings 92*a* and 92*b* mounted on a bearing support 94 affixed to a clamp or clamping member 96 on which rack 76 is mounted. Clamp 96 is clamped to the edge of a work table 98 and support arm 84 is connected to clamp 96 by a support member 100 which is affixed thereto by screws 102. It will be appreciated that spindle 74 is similarly mounted and a second bearing block 91, corresponding to, and of the same construction as, bearing block 90, is shown in FIG. 10.

As shown in both FIGS. 10 and 11, a bellcrank 104 is mounted for rotation on a downwardly depending shaft 106 affixed to support member 100. As shown in FIG. 10, bellcrank 104 is connected by connecting arms 108 and 109, respectively, to the bearing blocks 90 and 91, such that the throw of the two bearing blocks 90, 91 is equalized. It will, of course, be appreciated that such a bellcrank arrangement is completely conventional in and of itself and that by rotating bellcrank 104 the bearing blocks 90 and 91 will be caused to move, and thus the spindles 72, 74 will move, toward and away from each other as described above so as to, for example, move spindles 72, 74 from the widely spaced positions shown in solid lines in FIG. 10 to closely spaced positions shown in phantom in FIG. 10.

As indicated above, a knee pad actuator (not shown) is preferably employed to effect rotation of bellcrank 104 but any suitable actuator mechanism for imparting rotation can be used.

Again, the basic operation of device 10 has been described above in connection with FIGS. 9(*a*) to 9(*e*). The device or machine of FIGS. 10 and 11 is designed to tightly roll fabrics of different weights for several products including the sunglasses or eyeglasses receptacle or retainer device mentioned above. In an exemplary, non-limiting implementation, fabric F is formed as a square of about six inches on a side and the spindles 72 and 74 travel over a distance of about five and one-half inches, so that when the fabric is first stretched out as shown in FIG. 9(*a*), the excess portion freely extending beyond each spindle as shown in FIG. 9(*b*), is about one-half inch. With the spindles 72, 74 rolled together as shown in FIG. 9(*c*), they are spaced apart about one-half inch center to center.

The mandrels or clips 80 and 82 discussed above are removed as unit with the rolled fabric F. It will be understood that the mandrels 80, 82 will still be rolled tightly with the fabric F at this point and make it much easier to remove the stretchy or elasticized fabric from the spindles 72, 74. Moreover, the mandrels 80, 82 act as a temporary backbone or spine which facilitates storing the rolled fabric between operations, i.e., prior to affixing the two rolled ends by sewing or other means, as mentioned above.

Although the invention has been described above in relation to preferred embodiments thereof, it will be understood by those skilled in the art that variations and modifications can be effected in these preferred embodiments without departing from the scope and spirit of the invention.

What is claimed:

1. A device for producing a double roll fabric construction comprising adjacent rolled up portions disposed in side by side relation so as to be unrollable to form a receiving space therebetween, said device comprising:

first and second spindles disposed in parallel relation and adapted to respectively receive opposite ends of a stretchable fabric so that rotation of said spindles causes rolling up of the fabric around the spindles;

a rack member;

first and second pinion gears mounted on said first and second spindles, respectively, and disposed in engagement with said rack member; and drive means for producing movement of said first and second pinion gears toward each other along said rack member so as to produce rotation of said first and second spindles and resultant wrapping of the fabric around the respective spindles to produce respective fabric rolls of the double roll fabric construction.

2. A device as claimed in claim 1 further comprising retaining means for retaining the fabric against said spindles so as to permit wrapping of the fabric around the spindles.

3. A device as claimed in claim 2 wherein said retaining means comprises first and second spaced, resilient fingers, between which said fabric is initially stretched, for holding the opposite ends of the fabric against said first and second spindles, respectively.

4. A device as claimed in claim 3 wherein said fingers are spaced apart a distance relative to the width of the fabric such that excess portions of the fabric extend beyond the fingers at both of said opposite ends of the fabric.

5. A device as claimed in claim 3 wherein said fingers comprise oppositely extending finger members formed integrally with a common base member.

6. A device as claimed in claim 2 further comprising securing means for securing fabric to the spindles.

7. A device as claimed in claim 6 wherein said securing means comprises removable clip members.

8. A device as claimed in claim 7 wherein said clip members comprise substantially semicircular mandrels.

9. A device as claimed in claim 1 further comprising securing means for securing fabric to the spindles.

10. A device as claimed in claim 9 wherein said securing means comprise removable clip members.

11. A device as claimed in claim 10 wherein said clip members comprise substantially semicircular mandrels.

12. A device as claimed in claim 1 further comprising first and second sliding blocks on which said first and second spindles are mounted.

13. A device as claimed in claim 12 wherein said device further includes a support assembly for supporting the device on a support member and wherein said sliding blocks include bearings which engage and ride on linear bearing surfaces of said support assembly.

14. A device as claimed in claim 1 wherein said drive means comprises spindle movement control means for producing equal movements of said first and second pinion gears along said rack member.

15. A device as claimed in claim 14 wherein said spindle movement control means comprises a bell crank and first and second links of equal length coupling the bell crank to the spindles.

16. A device as claimed in claim 15 further comprising first and second sliding blocks on which said spindles are mounted, said links being coupled to sliding blocks to produce movement of said spindles.

17. A device as claimed in claim 16 wherein said device further includes a support assembly for supporting the device on a support member and wherein said sliding blocks include bearings which engage and ride on linear bearing surfaces of said support assembly, and wherein said bell crank is mounted on said support assembly.

* * * * *